US012196225B2

(12) United States Patent
Kabasawa

(10) Patent No.: US 12,196,225 B2
(45) Date of Patent: Jan. 14, 2025

(54) VACUUM PUMP

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 18/000,750

(22) PCT Filed: Jun. 4, 2021

(86) PCT No.: PCT/JP2021/021365
§ 371 (c)(1),
(2) Date: Dec. 5, 2022

(87) PCT Pub. No.: WO2021/251290
PCT Pub. Date: Dec. 16, 2021

(65) Prior Publication Data

US 2023/0213044 A1 Jul. 6, 2023

(30) Foreign Application Priority Data

Jun. 12, 2020 (JP) ..... 2020-102009

(51) Int. Cl.
*F04D 29/70* (2006.01)
*F04D 19/04* (2006.01)
*F04D 27/00* (2006.01)

(52) U.S. Cl.
CPC ..... *F04D 29/701* (2013.01); *F04D 19/042* (2013.01); *F04D 27/001* (2013.01)

(58) Field of Classification Search
CPC ..... F04D 29/701; F04D 19/042; F04D 27/001
See application file for complete search history.

(56) References Cited

U.S. PATENT DOCUMENTS

2009/0301517 A1* 12/2009 Asayama ..... B08B 7/0035 134/1.1
2019/0285090 A1 9/2019 Smith et al.
(Continued)

FOREIGN PATENT DOCUMENTS

JP H078590 2/1995
JP 2001132684 A 5/2001
(Continued)

OTHER PUBLICATIONS

Seiko Seiki Co., Ltd. (JP H078590) machine translation (Year: 1995).*
(Continued)

*Primary Examiner* — Courtney D Heinle
*Assistant Examiner* — Andrew Thanh Bui
(74) *Attorney, Agent, or Firm* — Theodore M. Magee; Westman, Champlin & Koehler, P.A.

(57) ABSTRACT

A vacuum pump is provided that can remove deposits without overhauling and also detect completion of removal of deposits. A cleaning function portion for a cleaning function that performs cleaning of a deposit in a vacuum pump and a deposition sensor for a deposition detection function that detects the deposit are provided. A reading circuit portion and a cleaning completion determination circuit portion for a cleaning completion determination function that determines completion of cleaning are provided. The cleaning completion determination circuit portion outputs a cleaning completion signal indicating completion of the cleaning, based on a detection result of the deposition sensor.

7 Claims, 12 Drawing Sheets

(56) References Cited

U.S. PATENT DOCUMENTS

| | | | | |
|---|---|---|---|---|
| 2020/0355190 | A1* | 11/2020 | Bailey | F04D 19/046 |
| 2022/0097000 | A1* | 3/2022 | Lee | B01D 53/68 |
| 2022/0308255 | A1* | 9/2022 | Lee | G01V 11/00 |
| 2022/0333612 | A1* | 10/2022 | Ichihara | F04D 19/042 |

FOREIGN PATENT DOCUMENTS

| | | | |
|---|---|---|---|
| JP | 2004117091 | A | 4/2004 |
| JP | 2011080407 | A | 4/2011 |
| JP | 2018159632 | A | 10/2018 |
| JP | 2019120157 | A | 7/2019 |
| WO | 2019131682 | A1 | 7/2019 |

OTHER PUBLICATIONS

Shimadzu Corporation (JP 2001132684) machine translation (Year: 2001).*

PCT International Search Report dated Jul. 6, 2021 for corresponding PCT application Serial No. PCT/JP2021/021365, 2 pages.

PCT International Written Opinion dated Jul. 6, 2021 for corresponding PCT application Serial No. PCT/JP2021/021365, 4 pages.

European communication dated Jun. 3, 2024 for corresponding European application Serial No. 21821466.3-1004, 7 pages.

* cited by examiner

BEFORE CLEANING
(OPTICAL/TRANSMISSION)

AFTER CLEANING
(OPTICAL/TRANSMISSION)

BEFORE CLEANING
(OPTICAL/REFLECTION)

AFTER CLEANING
(OPTICAL/REFLECTION)

VACUUM PUMP

CROSS-REFERENCE OF RELATED APPLICATION

This application is a Section 371 National Stage Application of International Application No. PCT/JP2021/021365, filed Jun. 4, 2021, which is incorporated by reference in its entirety and published as WO 2021/251290A1 on Dec. 16, 2021 and which claims priority of Japanese Application No. 2020-102009, filed Jun. 12, 2020.

BACKGROUND

The present invention relates to a vacuum pump such as a turbomolecular pump.

A turbomolecular pump is commonly known as one type of vacuum pump. In a turbomolecular pump, a motor in a pump main body is energized to rotate rotor blades, which hit gaseous molecules of gas (process gas) drawn into the pump main body, thereby exhausting the gas. Some types of such a turbomolecular pump have heaters and cooling pipes to appropriately manage a temperature inside pumps.

The discussion above is merely provided for general background information and is not intended to be used as an aid in determining the scope of the claimed subject matter. The claimed subject matter is not limited to implementations that solve any or all disadvantages noted in the background.

SUMMARY

In a vacuum pump such as the turbomolecular pump described above, substances in the gas being transferred may be deposited. For example, gas used in an etching process of a semiconductor manufacturing apparatus compresses gas (process gas) drawn into a pump main body and gradually increases the pressure. In this process, if a temperature of an exhaust flow passage decreases below a sublimation temperature, the gas may cause side reaction products to be deposited in the vacuum pump and piping, thereby blocking the exhaust flow passage. Also, in the process of compressing the gas drawn from a pump inlet port in the pump, the pressure of the drawn gas may exceed pressure at which a phase changes from gas to solid, thereby causing the gas to change into a solid in the pump. As a result, solids of side reaction products may accumulate in the pump, and these deposits may cause problems. Also, to remove the deposits of side reaction products, a vacuum pump and piping need to be cleaned. Moreover, in some cases, the vacuum pump and piping need to be repaired or replaced with new ones. Overhaul for such work may temporarily stop operation of the semiconductor manufacturing apparatus. Furthermore, a period of overhaul may prolong to several weeks or more in some cases.

Some conventional vacuum pumps have the function of increasing a temperature of an internal exhaust path using a heater during a normal exhaust operation to prevent side reaction products from adhering to the interior (Japanese Patent Application Publication No. 2011-80407). Japanese Patent Application Publication No. 2011-80407 discloses an invention that heats a downstream side of an exhaust flow passage of a pump to increase a sublimation pressure of the drawn gas and thus allows the downstream side to be a gas phase area. This prevents side reaction products from accumulating in the pump and blocking the exhaust flow passage. Such heating may expand or deform components of the vacuum pump and bring the components into contact with one another. To avoid this, a limit is set on the temperature increase (target temperature for heating) to manage the temperature so as not to rise above a preset value. Various measures have been devised to manage the temperature within a permissible temperature range in which a pump can be used without problems, and also to prevent deposition of side reaction products. However, depending on the type of side reaction products, it may be difficult to operate the vacuum pump under temperature conditions that can completely prevent deposition. As a result, side reaction products are deposited, and the semiconductor manufacturing apparatus has to be stopped to clean or repair the vacuum pump.

While various measures have been devised for pump temperature managing methods, little attention has been paid to methods that efficiently clean and repair vacuum pumps. It is an object of the present invention to provide a vacuum pump that can remove deposits without overhauling and also detect completion of removal of deposits.

(1) To achieve the above object, the present invention is directed to a vacuum pump for exhausting gas by rotating a rotor blade, the vacuum pump including:

a cleaning function portion for a cleaning function that performs cleaning of a deposit in the vacuum pump; and a deposition detection function portion for a deposition detection function that detects the deposit.

(2) To achieve the above object, another aspect of the present invention is directed to the vacuum pump according to (1) further including a cleaning completion determination function portion for a cleaning completion determination function that determines completion of the cleaning.

The cleaning completion determination function portion is configured to output a cleaning completion signal indicating completion of the cleaning, based on a detection result of the deposition detection function portion.

(3) To achieve the above object, another aspect of the present invention is directed to the vacuum pump according to (2), wherein the cleaning completion determination function portion is configured to determine completion of the cleaning, based on the detection result of the deposition detection function portion and a changeable threshold value.

(4) To achieve the above object, another aspect of the present invention is directed to the vacuum pump according to any one of (1) to (3), wherein the deposition detection function portion includes:

a light projecting portion oriented toward a flow passage of exhaust gas;

a light receiving portion that faces the light projecting portion across the flow passage and is configured to receive detection light projected from the light projecting portion.

(5) To achieve the above object, another aspect of the present invention is directed to the vacuum pump according to any one of (1) to (3), wherein the deposition detection function portion includes:

a light projecting portion oriented toward a flow passage of exhaust gas; and a reflection portion arranged to face the light projecting portion across the flow passage and is configured to reflect detection light projected from the light projecting portion toward the flow passage; and alight receiving portion configured to receive the detection light reflected by the reflection portion.

(6) To achieve the above object, another aspect of the present invention is directed to the vacuum pump according to (5), wherein the light projecting portion and a reflection surface of the reflection portion are arranged at a predetermined angle other than 90 degrees.

(7) To achieve the above object, another aspect of the present invention is directed to the vacuum pump according to any one of (1) to (3), wherein the deposition detection function portion includes at least one pair of electrodes positioned within a flow passage of exhaust gas, and the deposition detection function portion is configured to be capable of detecting a change in one or both of a resistance and a capacitance between the electrodes.

(8) To achieve the above object, another aspect of the present invention is directed to the vacuum pump according to (7), further including: a temperature detection function portion configured to detect a temperature of a section to which the deposition detection function portion is attached; and a detected value correction function portion configured to correct a detected value read from a detection amount of the deposition detection function portion, based on a detection result of the temperature detection function portion.

According to the above invention, a vacuum pump is provided that can remove deposits without overhauling and also detect the completion of removal of deposits.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
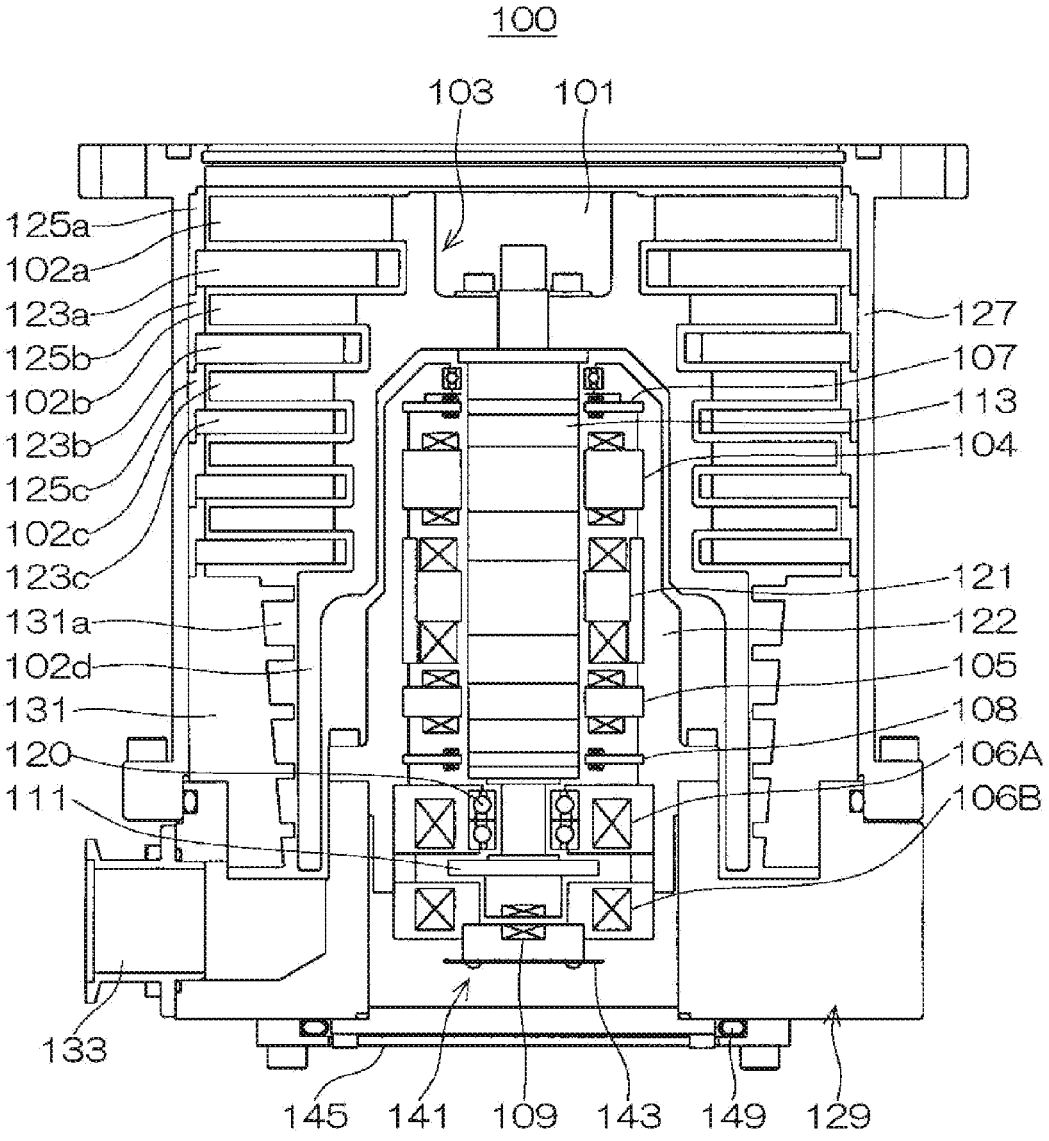
FIG. 1 is a vertical cross-sectional view of a turbomolecular pump according to an embodiment of the present invention.

Referring to the drawings, a vacuum pump according to an embodiment of the present invention is now described. FIG. 1 shows a turbomolecular pump 100 as a vacuum pump according to an embodiment of the present invention. The turbomolecular pump 100 is to be connected to a vacuum chamber (not shown) of a target apparatus such as a semiconductor manufacturing apparatus.

FIG. 1 is a vertical cross-sectional view of the turbomolecular pump 100. As shown in FIG. 1, the turbomolecular pump 100 has a circular outer cylinder 127 having an inlet port 101 at its upper end. A rotating body 103 in the outer cylinder 127 includes a plurality of rotor blades 102 (102*a*, 102*b*, 102*c*, which are turbine blades for gas suction and exhaustion, in its outer circumference section. The rotor blades 102 extend radially in multiple stages. The rotating body 103 has a rotor shaft 113 in its center. The rotor shaft 113 is suspended in the air and position-controlled by a magnetic bearing of 5-axis control, for example.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects the position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the controller (not shown).

In the controller, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller.

In the controller, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller detects the position of the magnetic poles using both detection signals of the phase sensor and the rotational speed sensor.

A plurality of stator blades 123 (123*a*, 123*b*, 123*c*, . . . ) are arranged slightly spaced apart from the rotor blades 102*a*, 102*b*, 102*c*, . . . . Each rotor blade 102*a*, 102*b*, 102*c*, . . . is inclined by a predetermined angle from a plane perpendicular to the axis of the rotor shaft 113 in order to transfer exhaust gas molecules downward through collision.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 is then sent to the outlet port 133.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102*a*, 102*b*, 102*c*, . . . , a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread grooves 131*a* by the rotor blades 102 and the stator blades 123 is guided by the thread grooves 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction path. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is conducted to the stator blades 123 through radiation or conduction via gas molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread grooves 131*a* are engraved in the inner circumference surface of the threaded spacer 131. However, this may be inversed in some cases, and a thread groove may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blade 102.

The turbomolecular pump 100 requires the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when $SiCl_4$ is used as the process gas in an Al etching apparatus, according to the vapor pressure curve, a solid product (for example, $AlCl_3$) is deposited at a low vacuum (760 [torr] to $10^{-2}$ [torr]) and a low temperature (about 20 [° C.]) and adheres and accumulates on the inner side of the turbomolecular pump 100. When the deposit of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port and the vicinity of the threaded spacer 131.

To solve this problem, conventionally, a heater or annular water-cooled tube 149 (not shown) is wound around the outer circumference of the base portion 129, and a temperature sensor (e.g., a thermistor, not shown) is embedded in the base portion 129, for example. The signal of this temperature sensor is used to perform control to maintain the temperature of the base portion 129 at a constant high temperature (preset temperature) by heating with the heater or cooling with the water-cooled tube 149 (hereinafter referred to as TMS (temperature management system)).

Figure 2:
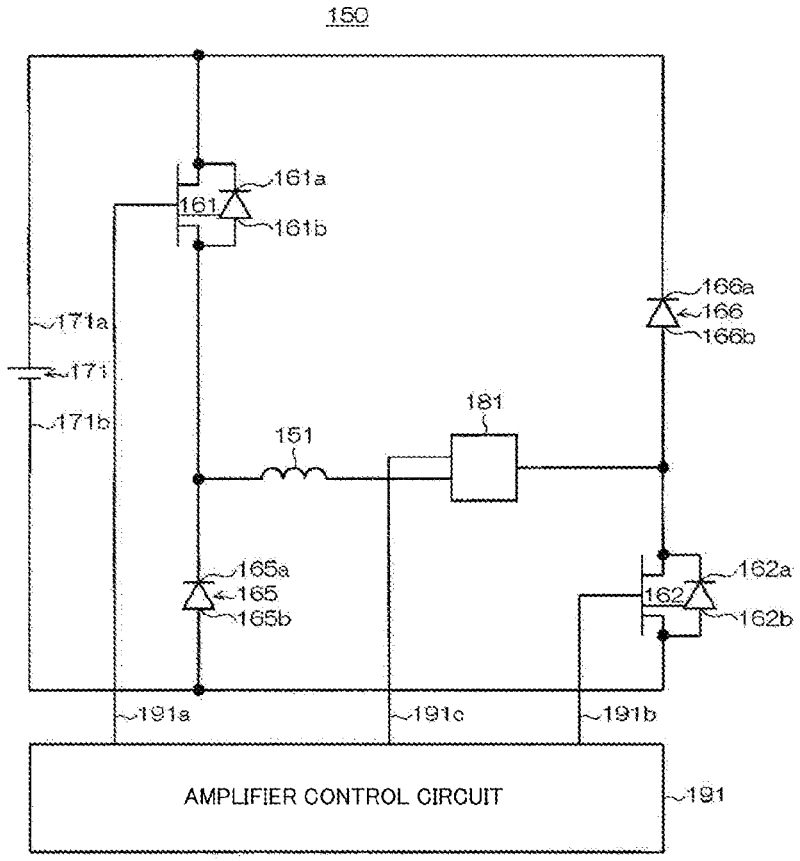
FIG. 2 is a circuit diagram of an amplifier circuit.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit 150.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may require positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
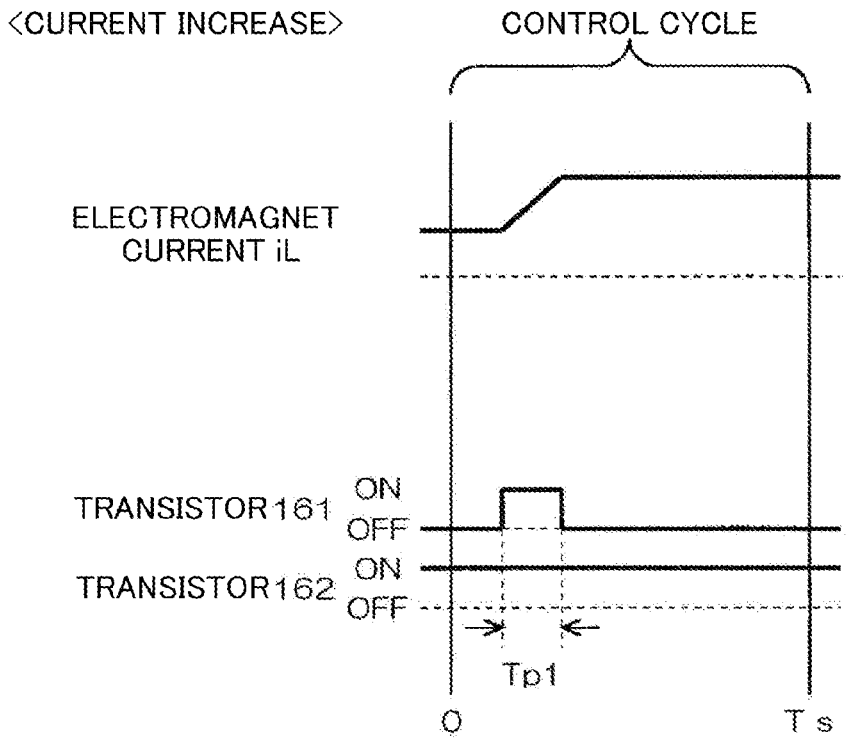
FIG. 3 is a time chart showing control performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
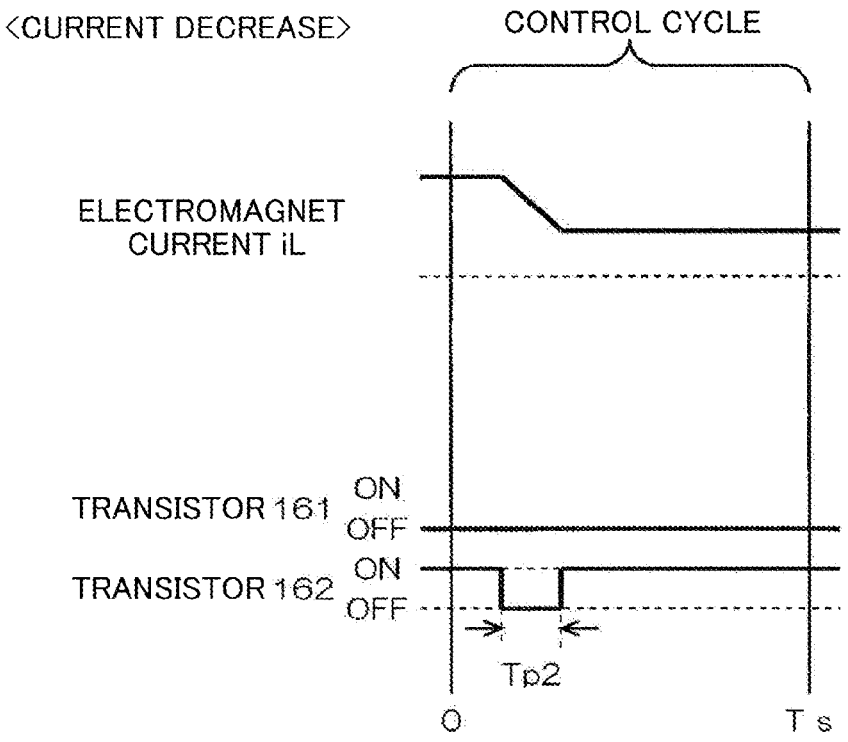
FIG. 4 is a time chart showing control performed when a current command value is less than a detected value.

When the detected current value is larger than the current command value, as shown in FIG. 4, the transistors 161 and 162 are simultaneously off only once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 is tuned on. During this period, the freewheeling current is thus maintained in the amplifier circuit 150.

In the turbomolecular pump 100 with the basic configuration described above, the upper side as viewed in FIG. 1 (the side including the inlet port 101) serves as a suction portion connected to the target apparatus, and the lower side (the side including the outlet port 133 protruding leftward as viewed in the figure from the base portion 129) serves as an exhaust portion connected to an auxiliary pump (back pump) or the like (not shown). The turbomolecular pump 100 can be used not only in an upright position in the vertical direction shown in FIG. 1, but also in an inverted position, a horizontal position, and an inclined position.

Also, in the turbomolecular pump 100, the above-mentioned outer cylinder 127 and the base portion 129 are combined to form a single case (hereinafter, they may be collectively referred to as a "main body casing" or the like). The turbomolecular pump 100 is electrically (and structurally) connected to a box-shaped electrical case (not shown), and the above-mentioned controller is incorporated in the electrical case.

The configuration within the main body casing (the combination of the outer cylinder 127 and the base portion 129) of the turbomolecular pump 100 may be divided into a rotation mechanism portion, which rotates the rotor shaft 113 and the like with the motor 121, and an exhaust mechanism portion, which is rotationally driven by the rotation mechanism portion. The exhaust mechanism portion may be divided into a turbomolecular pump mechanism portion, which may include the rotor blades 102 and the stator blades 123, and a thread groove pump mechanism portion, which may include the cylindrical portion 102*d* and the threaded spacer 131.

The above-mentioned purge gas (protection gas) is used to protect components such as the bearing portions and the rotor blades 102, prevents corrosion caused by the exhaust gas (process gas), and cools the rotor blades 102, for example. This purge gas may be supplied by a general technique.

For example, although not illustrated, a purge gas flow passage extending linearly in the radial direction may be provided in a predetermined section of the base portion 129 (for example, at a position approximately 180 degrees apart from the outlet port 133). The purge gas may be supplied to the purge gas flow passage (specifically, a purge port serving as a gas inlet) from the outside of the base portion 129 via a purge gas cylinder (e.g., N2 gas cylinder), a flow rate regulator (valve device), or the like.

The protective bearing 120 described above is also referred to as a "touchdown (T/D) bearing", a "backup bearing", or the like. In case of any trouble such as trouble in the electrical system or entry of air, the protective bearing 120 prevents a significant change in the position and orientation of the rotor shaft 113, thereby limiting damage to the rotor blades 102 and surrounding portions.

In the figures showing the structure of the turbomolecular pump 100 and the like (such as FIG. 1), hatch patterns indicating cross sections of components are omitted to avoid complicating the drawing.

A cleaning function, a deposition detection function, and a cleaning completion determination function of the turbomolecular pump 100 are now described. Among these, the cleaning function is a function for automatically removing deposits in the pump. Several cleaning techniques may be employed as the cleaning function.

Specific examples of the cleaning techniques include dry cleaning, wet cleaning, and heating removal (heat cleaning). The turbomolecular pump 100 may use one of dry cleaning, wet cleaning, and heating removal, or a combination of at least two of them.

In the dry cleaning, various gases (chlorine-based gas, fluorine-based gas, etc.) used as process gas are supplied as they are into the turbomolecular pump 100 as cleaning gas. Instead of supplying the process gases as they are, the process gases may be subjected to pretreatment (such as ionization by plasma) before being supplied into the turbomolecular pump 100.

Figure 5:
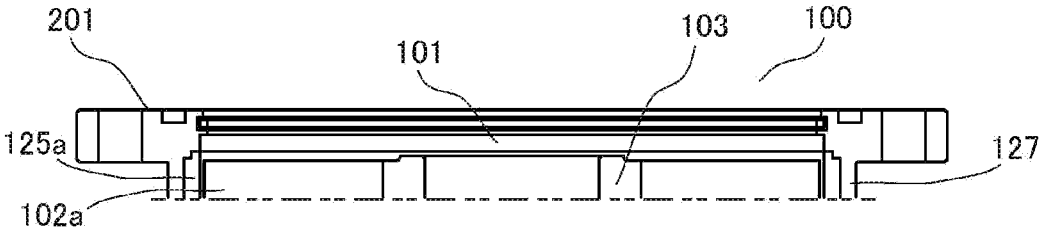
FIG. 5 is an enlarged view showing an area around an inlet port of a turbomolecular pump.

In this dry cleaning, as shown enlarged in FIG. 5, a suction-side flange portion 201 projecting around the inlet port 101 of the turbomolecular pump 100 is used as a cleaning gas supply port (cleaning function portion).

That is, the suction-side flange portion 201 is used for connection with a flange portion (not shown) of a chamber (or piping) of an exhaustion target apparatus (apparatus subjected to exhaustion), such as a semiconductor manufacturing apparatus or a flat-panel display manufacturing apparatus. The dry cleaning uses the process gas flowing from the exhaustion target apparatus. As such, the suction-side flange portion 201 also serves (doubles) as a configuration for achieving the cleaning function (cleaning function portion) and is used for the supply of cleaning gas, in addition to the exhaustion of the exhaustion target apparatus.

During dry cleaning, the motor 121 may be rotated at a rotation speed that can be used to exhaust the cleaning gas (such as a rotation speed lower than that during steady operation).

In the above-mentioned wet cleaning, predetermined cleaning liquid (such as water, acid, organic solvent, or other chemical) is supplied into the turbomolecular pump 100. Although not shown, for this wet cleaning, a port for introducing the cleaning liquid may be provided at any section (for example, the base portion 129) of the main body casing (the combination of the outer cylinder 127 and the base portion 129).

In this wet cleaning, a cleaning liquid introduction port (not shown), a cleaning liquid supply source, cleaning liquid supply piping, and the like serve as a cleaning function portion that is a configuration for achieving the cleaning function.

In the above-mentioned heating removal (heat cleaning), a predetermined section inside the pump is heated to a temperature (for example, about 100° C. to 150° C.) greater than or equal to the sublimation temperature of the process gas to gasify and discharge the deposits. For heating, a heater (not shown) provided for the TMS described above may be used. In this heating removal, the heater itself or a section relating to the arrangement or control of the heater, for example, serves as the above-mentioned cleaning function portion.

It should be noted that the heater may be arranged, instead of the outer circumference of the base portion 129 or the like, inside the base portion 129 or the threaded spacer 131 (inside or on the outer circumference thereof). It is also possible to install other heaters in addition to the TMS heater. Furthermore, heaters may be provided on both the base portion 129 and the threaded spacer 131.

As the heater provided on the heating target component (in this embodiment, the base portion 129 and the threaded spacer 131), various general heaters such as a cartridge heater, a sheath heater, an electromagnetic induction heater (IH heater), and the like may be used according to their characteristics. Also, a planar heater or the like may be used that is structured to have a limited degree of three-dimensional protrusion.

In a comparison of the different cleaning techniques described above, the dry cleaning and wet cleaning are techniques for dissolving deposits, and the heating removal is a technique for gasifying deposits. The dry cleaning and the wet cleaning, which involve erosiveness and corrosiveness, may be more likely to affect the components of the turbomolecular pump 100 than the heating removal.

For this reason, the heating removal may be considered desirable in minimizing the influence on components and maintaining the efficiency in the manufacturing of semiconductors and the like. Nevertheless, to allow the cleaning technique to be flexible and not limited to the heating removal, the cleaning function portions for the respective cleaning techniques may be provided in advance, and cleaning may be performed by selecting or combining them according to the situation.

Figure 6:
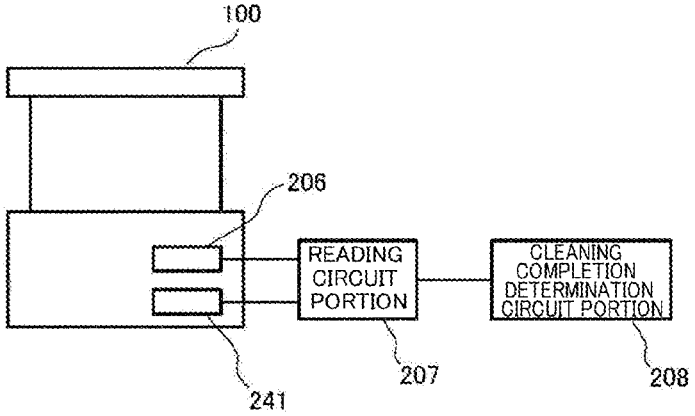
FIG. 6 is a block diagram showing function portions of the turbomolecular pump.

The above-mentioned deposition detection function and the cleaning completion determination function are now described. FIG. 6 conceptually illustrates the deposition detection function and the cleaning completion determination function of the turbomolecular pump 100. As shown in FIG. 6, the deposition detection function is achieved (performed) using a deposition sensor 206, which is provided inside the main body casing (the combination of the outer cylinder 127 and the base portion 129) of the turbomolecular pump 100, and a reading circuit portion 207, which receives an output signal of the deposition sensor 206. Both the deposition sensor 206 and the reading circuit portion 207 are used as a deposition detection function portion.

The cleaning completion determination function receives an output signal from the reading circuit portion 207 and determines whether the cleaning by the cleaning function is completed. This cleaning completion determination function is achieved (performed) using a cleaning completion determination circuit portion 208 serving as a cleaning completion determination function portion.

The reading circuit portion 207 and the cleaning completion determination circuit portion 208 may be set in the controller described above. The cleaning completion determination circuit portion 208 outputs a cleaning completion signal indicating the completion of cleaning, and notification of cleaning completion can be performed based on this cleaning completion signal.

Notification of cleaning completion may be performed in various forms. For example, the controller may have alight source (LED, lamp, etc.) for notification, and this light source may be turned on or blinked based on the cleaning completion signal. In another example, the controller may have a display capable of displaying texts and symbols. A message in texts or symbols indicating cleaning completion may be indicated on the display.

As the deposition detection technique of the deposition sensor 206, various types of techniques may be used such as a capacitive type (electrical type) and an optical type. Specific examples of different types of deposition detection techniques will be described below.

Figure 12:
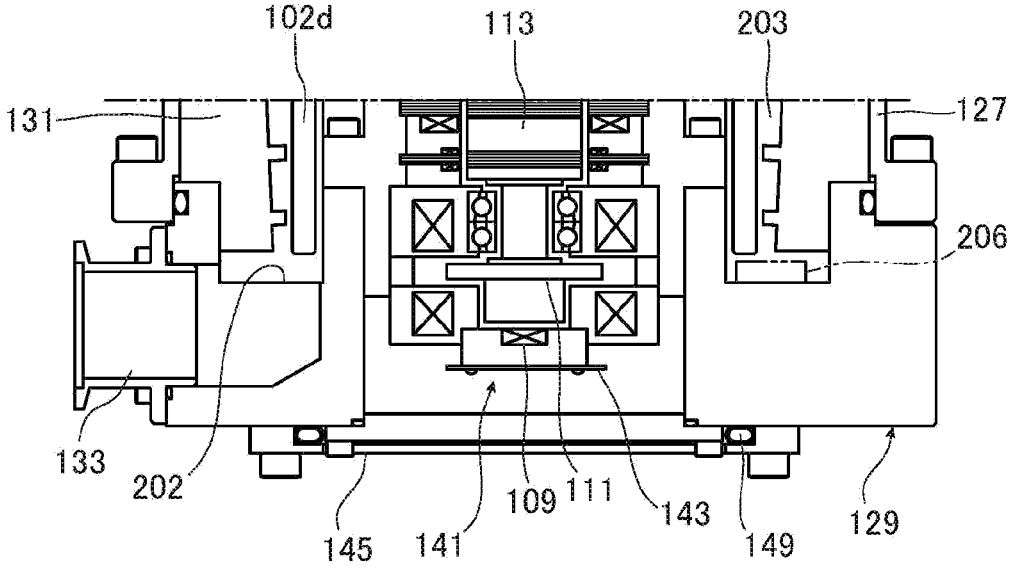
FIG. 12 is an enlarged view showing an area around a base portion of the turbomolecular pump.

As indicated by the dashed double-dotted line in FIG. 12, the deposition sensor 206 may be arranged in a section on the downstream side of the exhaust gas (process gas) in the turbomolecular pump 100. In the example of FIG. 12, the deposition sensor 206 is located on an inner bottom portion 202 of the base portion 129. Specifically, in the inner bottom portion 202 of the base portion 129, the deposition sensor 206 is arranged at a position facing a space 203 between the threaded spacer 131 and the cylindrical portion 102*d*. Although not shown, the deposition sensor 206 may be arranged in a section closer to the outlet port 133.

Figure 7:
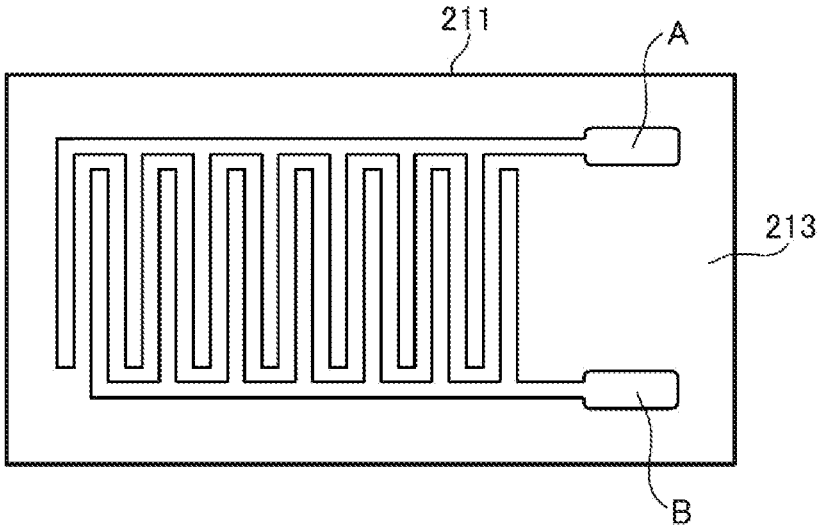
FIG. 7 is an explanatory diagram showing a sensor substrate used in a capacitive deposition detection technique.

The deposition detection technique of the deposition sensor 206 is now described. FIG. 7 schematically shows a sensor substrate 211 used in a capacitive deposition detection technique. For example, the sensor substrate 211 includes a rectangular insulating substrate (a ceramic substrate in this example) and a pair of comb-shaped electrodes (flat electrodes) A and B formed on one plate surface 213 of the insulating substrate.

The electrodes A and B are formed to oppose to each other without being in contact with or intersecting each other with their comb teeth interlocking but spaced apart by a predetermined gap. A high-frequency voltage is applied between the electrodes A and B to generate an electric field. The sensor substrate 211 is provided on the deposition sensor 206 such that the exhaust gas (process gas) is in contact with the plate surface 213 while flowing.

Figure 8A:
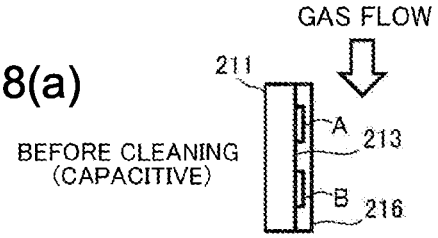
FIG. 8A is an explanatory diagram showing a state before cleaning in the detection principle regarding the capacitive deposition detection technique.
Figure 8B:
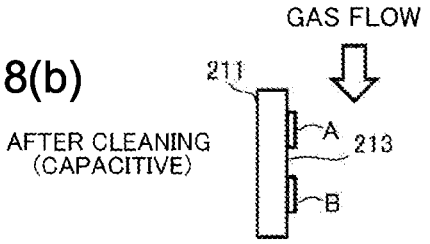
FIG. 8B is an explanatory diagram showing a state after cleaning.

FIGS. 8A and 8B show the principle of deposition detection using the sensor substrate 211. The operation of the turbomolecular pump 100 generates a flow of exhaust gas inside the pump as shown in FIG. 8A. The exhaust gas flows in contact with the plate surface 213 of the sensor substrate 211 as described above. Deposits of the process gas accumulate on the plate surface of the sensor substrate 211. Before cleaning, deposits 216 are formed around the electrodes A and B as shown in FIG. 8A.

The dielectric constant between the electrodes A and B may vary depending on factors such as the presence or absence of the deposits 216, the amount of the deposits 216, and the state of adhesion of the deposits 216. When the deposits 216 are removed by performing cleaning by the cleaning function described above as shown in FIG. 8B, the dielectric constant between the electrodes A and B differs from that before cleaning due to the absence of the deposits 216. The resistance between the electrodes A and B is maximized when the deposits 216 are absent between the electrodes A and B.

A change in dielectric constant between the electrodes A and B appears in an output signal of the deposition sensor 206 as a change in capacitance. The output signal of the deposition sensor 206 is input to the reading circuit portion 207 and read by the reading circuit portion 207. The reading circuit portion 207 converts the output signal between the electrodes A and B into numerical information and outputs it to the cleaning completion determination circuit portion 208.

The cleaning completion determination circuit portion 208 stores predetermined threshold value information, and the cleaning status is monitored based on the numerical information from the reading circuit portion 207 and the threshold value. A flow of process from performing cleaning to comparing with the threshold value (FIG. 11) will be described below.

In this example, the reading circuit portion 207 reads a change in the capacitance based on the dielectric constant between the electrodes A and B. However, the present invention is not limited to this, and the reading circuit portion 207 may read a change in the resistance between the electrodes A and B and convert it into numerical information. Also, both the capacitance and the resistance may be read by the reading circuit portion 207 and converted into numerical information.

Figure 9A:
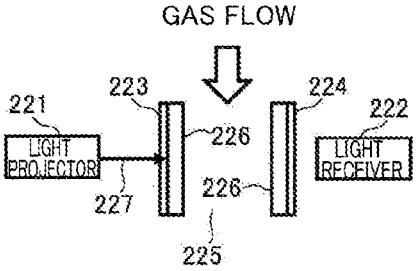
FIG. 9A is an explanatory diagram showing a state before cleaning in the detection principle regarding an optical deposition detection technique of a transmission type.
Figure 9B:
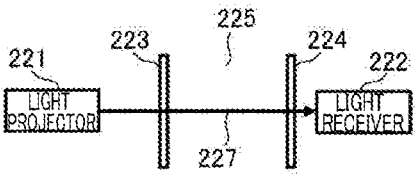
FIG. 9B is an explanatory diagram showing a state after cleaning.
Figure 10A:
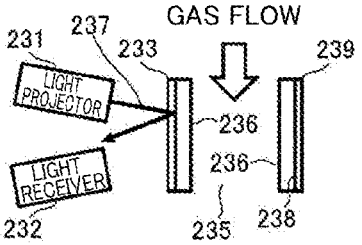
FIG. 10A is an explanatory diagram showing a state before cleaning in the detection principle regarding an optical deposition detection technique of a reflection type.
Figure 10B:
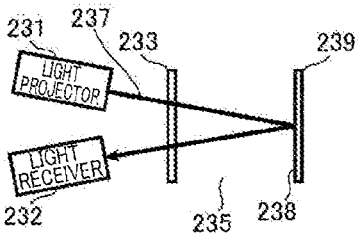
FIG. 10B is an explanatory diagram showing a state after cleaning.

As optical deposition detection techniques, FIGS. 9A and 9B show an example of an optical deposition detection technique of a transmission type, and FIGS. 10A and 10B show an example of an optical deposition detection technique of a reflection type.

Of these, in the transmission type shown in FIGS. 9A and 9B, two glass plates (light transmission plates) are placed between a light projector (light source) 221 and a light receiver (light receiving member) 222 facing each other. The glass plates 223 and 224 are arranged in parallel and spaced apart by a gap 225 serving as a flow passage of gas (process gas).

When the process gas is exhausted and deposits 226 adhere to the glass plates 223 and 224, detection light 227 emitted from the light projector 221 is blocked by the deposits 226 and does not reach the light receiver 222. The deposits 226 block the detection light 227, so that the light receiver 222 does not detect the detection light 227.

However, when the deposits 226 are removed as shown in FIG. 9B by performing cleaning by the cleaning function described above, the detection light 227 is incident on and detected by the light receiver 222 without being block by the deposits 226.

In the reflection type shown in FIGS. 10A and 10B, a light projector (light source) 231 and a light receiver (light receiving member) 232 are inclined at predetermined angles and provided at one side of one of the plate surfaces of one glass plate (light transmission plate) 233. At the side of the other plate surface of the glass plate 233, a reflection plate 239 having a reflection surface 238 is arranged. The reflection plate 239 is arranged in parallel with the glass plate 233 with a gap 235 between the reflection plate 239 and the glass plate 233 serving as a flow passage for gas (process gas).

When deposits 236 adhere to the glass plate 223 and the reflection plate 239, detection light 237 emitted from the light projector 231 is reflected by the deposits 236 (the boundary surface with the glass plate 233) and does not reach the reflection plate 239 or the light receiver 232. Although not shown, in a situation where deposits 236 adhere to one of the glass plate 223 and the reflection plate 239, the detection light 237 is also blocked by the deposits 236 and does not reach the light receiver 232.

However, when the deposits 236 are removed as shown in FIG. 10B by performing cleaning by the cleaning function described above, the detection light 237 is transmitted through the glass plate 233 without being blocked by the deposits 236 and thus reaches the reflection plate 239. Also, the detection light 237 is reflected by the reflection plate 239, transmitted through the glass plate 233 again, incident on the light receiver 232, and is therefore detected.

It may be described that the light projector 231 is installed such that the angle relationship between the orientation of the light projector 231 and the reflection surface 238 forms an angle other than 90 degrees. That is, if the angle relationship between the orientation of the light projector 231 and the reflection surface 238 is 90 degrees, the detection light 237 is incident on the reflection surface 238 at a right angle, and the reflected light returns to the light projector 231. As such, the light receiver 232 cannot detect the detection light 237. However, when the light projector 231 is arranged such that the angle relationship between the orientation of the light projector 231 and the reflection surface 238 forms an angle other than 90 degrees, the light receiver 232 can detect the detection light 237.

These examples are to describe the basic principle of the optical deposition detection technique, and the presence or absence of the detection light 227, 237 incident on the light receivers 222, 232 is described for both the transmission type and the reflection type. In these cases, the reading circuit portion 207 converts the presence or absence of the detection light 227, 237 incident on the light receivers 222, 232 into numerical information. However, the present invention is not limited to this, and an increase or decrease in the light amount of the detection light 227, 237 incident on the light receivers 222, 232 may be detected, and the detection result regarding the light amount of the detection light 227, 237 may be read out and converted into numerical information by the reading circuit portion 207.

Figure 11:
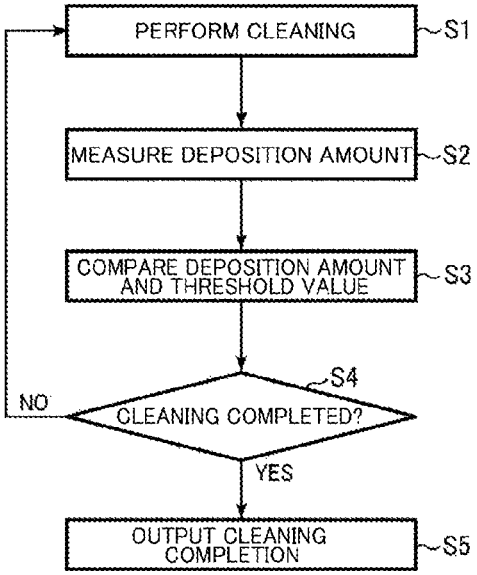
FIG. 11 is a flowchart schematically showing the flow of a process from performing cleaning of the turbomolecular pump and comparing with a threshold value.

FIG. 11 schematically shows the flow of process from performing cleaning to comparing with a threshold value. The process described here can be commonly applied to any of the deposition detection techniques described above.

As shown in FIG. 11, the cleaning function performs cleaning (S1), and then the deposition sensor 206 and the reading circuit portion 207 measure the deposition amount (S2). Then, the cleaning completion determination circuit portion 208 compares the deposition amount with a predetermined threshold value (S3). When the deposition amount decreases below the threshold value (or reaches the threshold value), it is determined that the cleaning is completed (YES at S4), and a cleaning completion signal is output indicating the completion of cleaning (S5).

At S4, when the deposition amount is not below the threshold value (or has not reached the threshold value) (No at S4), the process returns to S1, and the process of S1 to S4 is repeated. The example of FIG. 11 measures the deposition amount (S2) after performing cleaning (S1). However, the deposition amount measurement (S2) may be simultaneously performed while cleaning is performed. This allows the reduction process of the deposits 216 to be monitored.

A temperature detection function, a detected value correction function, and a threshold change function of the turbomolecular pump 100 are now described. Of these, the temperature detection function is achieved (performed) using a temperature sensor 241 as shown in FIG. 6. The temperature sensor 241 serves as a temperature detection function portion and is arranged on a component such as the threaded spacer 131, for example.

The section where the temperature sensor 241 is arranged may be a component other than the threaded spacer 131, but it is desirable to select a non-rotating component (stator component). Also, the temperature sensor 241 may be arranged on the surface of a component, or may be embedded in the component.

The temperature sensor 241 detects the temperature around the temperature sensor 241 in the target component (placement target component) on which the temperature sensor 241 is placed. The temperature sensor 241 outputs a signal as a detection result to the reading circuit portion 207, for example. Based on the output signal of the temperature sensor 241, the reading circuit portion 207 corrects the detection result of the deposition sensor 206 and outputs a signal indicating numerical information to the cleaning completion determination circuit portion 208. In this case, the reading circuit portion 207 serves as a detected value correction function portion that achieves (performs) the detected value correction function.

The present invention is not limited to the above, and the output signal of the temperature sensor 241 may be input to the cleaning completion determination circuit portion 208, and the cleaning completion determination circuit portion 208 may correct the output value of the reading circuit portion 207 to compare it with the threshold value. In this case, the cleaning completion determination circuit portion 208 serves as the detected value correction function portion described above.

It is also possible to output the output signal of the temperature sensor 241 to a control circuit portion (deposition amount correction control circuit portion) (not shown) that corrects the detection result of the deposition sensor 206, for example. In this case, the correction result of the deposition amount correction control circuit portion may be input to the cleaning completion determination circuit portion 208, and the cleaning completion determination circuit portion 208 may correct the output value of the reading circuit portion 207 and compare it with the threshold value. Furthermore, in this case, the deposition amount correction control circuit portion serves as the detected value correction function portion described above. The deposition amount correction control circuit portion may be provided in the above-mentioned controller.

The threshold change function is a function that allows the threshold value stored in the cleaning completion determination circuit portion 208 to be changed. The cleaning completion determination circuit portion 208 achieves (performs) this threshold change function.

The threshold value may be changed by a cleaning operator. The operator may perform an input operation to the above-mentioned controller (not shown) to change the stored threshold value information to another value. The threshold value may also be changed when the turbomolecular pump 100 is used for the first time as a new product, or when it is used for the second time or later as a non-new product.

The threshold value is used as a criterion for determining the completion of cleaning as described above. However, the characteristics are not necessarily constant due to factors including the variation of components and the individual differences of sensors of the turbomolecular pump 100 as a new product, and changes in components over time after starting use.

When the above-described capacitive deposition detection technique (FIGS. 7, 8A, and 8B) is adopted for the deposition sensor 206, the characteristics of the electrodes A and B may change depending on the erosiveness and corrosiveness of the process gas. A decrease in the width of the electrodes A and B changes the dielectric constant between the electrodes A and B accordingly.

When the above-described optical (transmission or reflection type) deposition detection technique (FIGS. 9A to 10B) is adopted for the deposition sensor 206, the glass plates (light transmission plates) 223, 224, 233 and the reflection plate 239 may become tarnished.

However, by allowing the threshold value to be changed as described above, the operator can perform cleaning while searching for an optimum value, allowing the cleaning function to be optimized.

According to the turbomolecular pump 100 described above, the cleaning function can remove the deposits (216, 226, 236) inside the pump without removing the pump. This minimizes the influence of deposits (216, 226, 236) in the pump on the operation of the exhaustion target apparatus and helps to improve the production efficiency concerning the products to be manufactured, such as semiconductors and flat-panel displays.

Moreover, the cleaning completion determination function allows for the automatic determination on whether cleaning is completed. Determining the completion of cleaning can reduce the cleaning operation as much as possible and minimize the number of man-hours involved in cleaning. Additionally, the cleaning operations can be performed consistently and efficiently.

Furthermore, the cleaning by means of heating removal minimizes the influence on the components of the turbomolecular pump 100 as compared with the dry cleaning or wet cleaning. When the process gas is ionized by plasma in dry cleaning, the power consumption increases accordingly. Wet cleaning requires cleaning liquid. Performing heating removal instead of dry cleaning or wet cleaning reduces the power consumption and eliminates the need for cleaning liquid.

The present invention is not limited to the above-described embodiments, and various modifications can be made without departing from the scope of the invention. For example, as a cleaning technique relating to the cleaning function, cleaning may be performed by applying ultrasonic waves to the entire turbomolecular pump 100 or its specific section. In this case, an ultrasonic generator or a vacuum pump component that ultrasonically vibrates (e.g., the threaded spacer 131) serves as the cleaning function portion for achieving the cleaning function.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump for exhausting gas by rotating a rotor blade, the vacuum pump comprising:

a cleaning function portion for a cleaning function that performs cleaning of a deposit in the vacuum pump;

a deposition detection function portion for a deposition detection function that detects the deposit; and a controller configured to operate in a cleaning mode wherein the controller provides a cleaning completion determination function portion monitoring the output of the deposition detection function portion to determine when to indicate that cleaning is completed during the cleaning mode, wherein the cleaning function portion is dry cleaning, wet cleaning, heating removal and/or a vacuum pump component that ultrasonically vibrates, the cleaning is performed by the cleaning function portion, and the cleaning completion determination function portion is configured to output a cleaning completion signal indicating completion of the cleaning, based on a detection result of the deposition detection function portion.

2. The vacuum pump according to claim 1, wherein the controller uses a changeable threshold value to determine when to indicate that cleaning is completed.

3. The vacuum pump according to claim 1, wherein the deposition detection function portion includes:

a light projecting portion oriented toward a flow passage of exhaust gas; and a light receiving portion that faces the light projecting portion across the flow passage and is configured to receive detection light projected from the light projecting portion.

4. The vacuum pump according to claim 1, wherein the deposition detection function portion includes:

a light projecting portion oriented toward a flow passage of exhaust gas;

a reflection portion arranged to face the light projecting portion across the flow passage and is configured to reflect detection light projected from the light projecting portion toward the flow passage; and a light receiving portion configured to receive the detection light reflected by the reflection portion.

5. The vacuum pump according to claim 4, wherein the light projecting portion and a reflection surface of the reflection portion are arranged at a predetermined angle other than 90 degrees.

6. The vacuum pump according to claim 1, wherein the deposition detection function portion includes at least one pair of electrodes positioned within a flow passage of exhaust gas, and the deposition detection function portion is configured to be capable of detecting a change in one or both of a resistance and a capacitance between the electrodes.

7. The vacuum pump according to claim 6, further comprising:

a temperature detection function portion configured to detect a temperature of a section to which the deposition detection function portion is attached; and a detected value correction function portion configured to correct a detected value read from a detection amount of the deposition detection function portion, based on a detection result of the temperature detection function portion.

* * * * *